US006312280B1

(12) United States Patent
Stevenson

(10) Patent No.: US 6,312,280 B1
(45) Date of Patent: Nov. 6, 2001

(54) FLEXIBLE CIRCUIT BOARD CONNECTOR HAVING INSULATION REMOVAL MECHANISM

(75) Inventor: Robin Stevenson, Bloomfield, MI (US)

(73) Assignee: General Motors Corporation, Detroit, MI (US)

( * ) Notice: Subject to any disclaimer, the term of this patent is extended or adjusted under 35 U.S.C. 154(b) by 0 days.

(21) Appl. No.: 09/684,456

(22) Filed: Oct. 10, 2000

(51) Int. Cl.[7] ..... H01R 4/24
(52) U.S. Cl. ..... 439/393; 439/495; 439/864
(58) Field of Search ..... 439/495, 393, 439/864, 409, 410, 863

(56) References Cited

U.S. PATENT DOCUMENTS

| | | | | |
|---|---|---|---|---|
| 3,579,283 | * | 5/1971 | Welburn et al. | 439/864 |
| 3,824,529 | * | 7/1974 | Dorell | 439/864 |
| 4,522,460 | * | 6/1985 | Beck, Jr. et al. | 439/393 |
| 5,961,344 | * | 10/1999 | Rosales et al. | 439/495 |
| 6,036,532 | * | 3/2000 | Feistkorn | 439/864 |

FOREIGN PATENT DOCUMENTS

| | | | | |
|---|---|---|---|---|
| 758921 | * | 10/1956 | (GB) | 439/864 |

* cited by examiner

*Primary Examiner*—Hien Vu
(74) *Attorney, Agent, or Firm*—George A. Grove; Jeffrey A. Sedlar

(57) ABSTRACT

An improved connector establishes an electrical connection between an external conductor and a planar conductor of an insulated flexible circuit board, utilizing an automatically deployed cutting mechanism for removing insulative material overlying the flexible circuit conductor when the electrical connection is established. The connector includes an insulative housing having a slot for receiving an interconnect stub of the flexible circuit, and a compliantly mounted cutting mechanism electrically coupled to the external conductor. The cutting mechanism extends partially into the slot, and is compliantly displaced away from the slot as the interconnect stub is inserted into the slot. When the interconnect stub is partially extracted from the slot, the cutting mechanism forcibly engages the stub, removing a portion of the overlying insulative material, and electrically contacting the flexible circuit conductor to establish the electrical connection between it and the external conductor.

6 Claims, 3 Drawing Sheets

FLEXIBLE CIRCUIT BOARD CONNECTOR HAVING INSULATION REMOVAL MECHANISM

TECHNICAL FIELD

This invention relates to a connector for making electrical contact with a planar conductor of a flexible circuit board, and more particularly to a flexible circuit board connector that automatically removes an insulation layer covering the planar conductor.

BACKGROUND OF THE INVENTION

Flexible circuit boards have commonly been used in the electronic industry to provide convenient multi-wire interconnects between rigid circuit boards and other fixed components. Flexible circuit boards can similarly be used to form an extended bus for supporting multiplexed communications among remotely located electronic modules, so long as provision is made for electrically coupling to the bus conductors at various locations along the length of the flexible circuit. In a motor vehicle application, for example, it would be necessary to couple numerous remote devices to the bus, and to leave open the possibility of adding further remote devices to the vehicle at a later date. However, the flexible circuit conductors are encased in an insulating medium, and it is necessary to remove the insulation overlying the conductors before a connector may be mated to the flexible circuit. This is a time-consuming operation that must be performed with care and precision in order to remove the insulation without also breaking through and removing the planar conductors, which can be as thin as 75 micrometers. Accordingly, what is needed is a connector that makes electrical contact with an insulated flexible circuit conductor without requiring prior removal of insulation overlying or underlying the conductor.

SUMMARY OF THE INVENTION

The present invention is directed to an improved connector for establishing an electrical connection between an external conductor and an insulated flexible circuit board conductor, the connector including an automatically deployed cutting mechanism for removing insulative material overlying the flexible circuit conductor when the electrical connection is established. The connector includes an insulative housing having a slot for receiving an interconnect stub of the flexible circuit, and a compliantly mounted cutting mechanism electrically coupled to the external conductor. The cutting mechanism extends partially into the slot, and is compliantly displaced away from the slot as the interconnect stub is inserted into the slot. When the interconnect stub is partially extracted from the slot, the cutting mechanism forcibly engages the stub, removing a portion of the overlying insulative material, and electrically contacting the flexible circuit conductor to establish the connection between it and the external conductor.

In a preferred embodiment, the cutting mechanism is defined by a threaded cylinder electrically coupled to the external conductor by a spring. The cylinder is supported in a tapered recess of the housing, and the spring biases the cylinder toward a narrow portion of the recess, in which position the cylinder extends partially into the housing slot. When the flexible circuit interconnect stub is inserted into the slot, the spring yields as the cylinder moves into a wider portion of the recess and away from the slot. When the interconnect stub is partially extracted from the slot, the spring biases the cylinder back into the narrow portion of the recess, whereupon the cylinder threads engage the stub and remove the overlying insulative material to establish the electrical connection between the flexible circuit conductor and the external conductor.

DESCRIPTION OF THE PREFERRED EMBODIMENT

Figure 1:
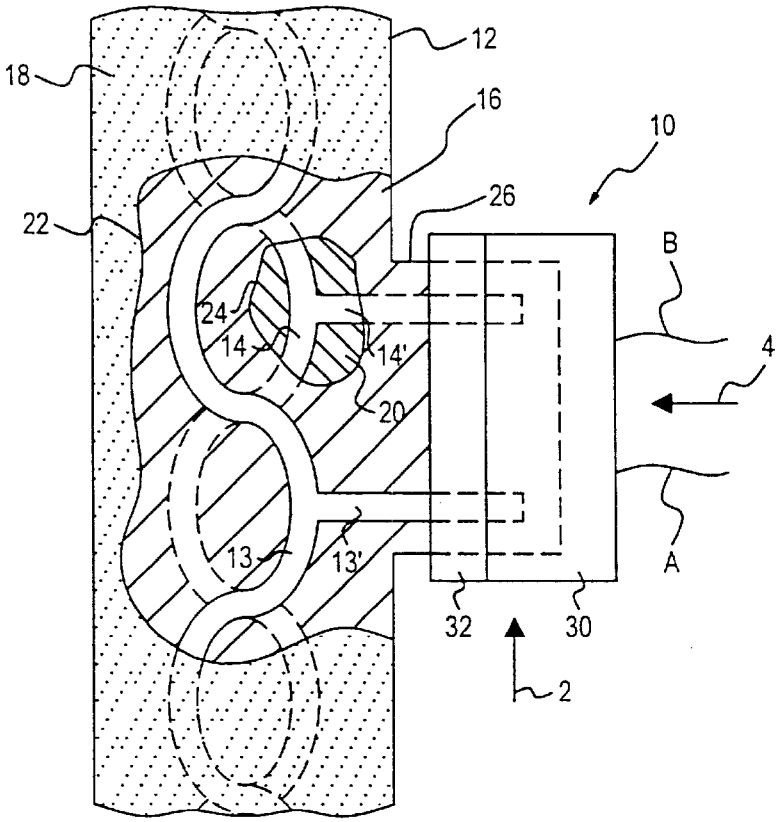
FIG. 1 is a schematic diagram of a flexible circuit board having an interconnect stub and an outline view of a connector according to this invention.

FIG. 1 is a top or overhead view of a connector 10 according to this invention, as attached to an elongated flexible circuit board 12. In the illustrated embodiment, the circuit board 12 supports a pair of planar conductors 13, 14, and the connector 10 electrically connects the external conductors A and B to the planar conductors 13, 14, respectively.

While the connector 10 is applicable to a variety of flexible circuit board designs, the illustrated flexible circuit board 12 is a multiple layer device particularly suited to bus applications, for example. The conductors 13 and 14 are separated by an intermediate insulation layer or substrate 16, and encased by top and bottom insulation layers 18, 20. For purposes of illustration, the top insulation layer 18 is partially removed as indicated by reference numeral 22 to reveal conductor 13 and intermediate insulation layer 16, and the intermediate insulation layer 16 is partially removed as indicated by reference numeral 24 to reveal the conductor 14 and bottom insulation layer 20. In a preferred implementation, the conductors 13 and 14 periodically cross to form a pseudo-twisted pair, and interconnect stubs 26 are provided at various intervals along the length of flexible circuit 12 to accommodate attachment of remotely located electronic modules (not shown) to the conductors 13, 14. As illustrated, the interconnect stub 26 extends laterally from the flexible circuit 12, and the conductors 13, 14 include lateral planar spurs 13', 14' that extend at least partially into the stub 26 as shown.

Figure 2:
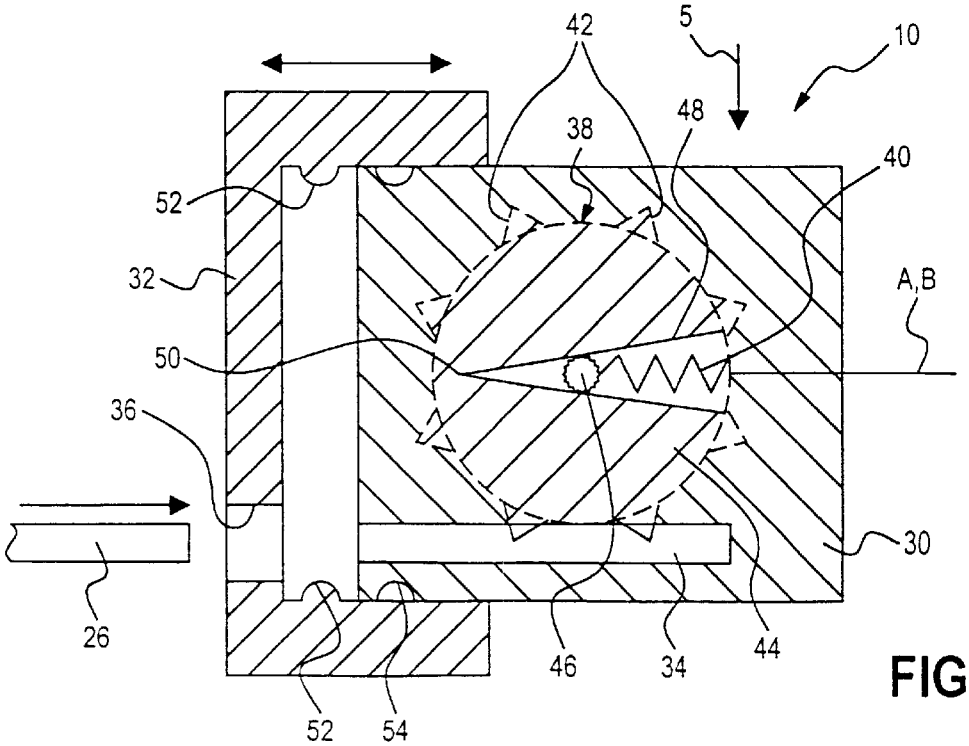
FIG. 2 is a schematic diagram of the connector of FIG. 1 according to a preferred embodiment of this invention.

FIG. 2 schematically depicts a side view (that is, in the direction of arrow 2 in FIG. 1) of the connector 10 according to a preferred embodiment of this invention. The internal elements of connector 10 are disposed within an insulative housing 30, and a locking mechanism 32 is slidably disposed on the exterior periphery of housing 30 as shown for purposes of clamping the stub 26 to connector 10 following attachment thereto. The housing 30 includes a lateral cavity or slot 34 sized to closely receive a portion of the interconnect stub 26 as shown, and the locking mechanism 32 has a corresponding aperture 36 adapted to accommodate insertion of the stub 26 into the housing slot 34. An electrically conductive cutting element 38 is compliantly mounted within the housing 30 by virtue of the housing geometry and an electrically conductive spring element 40. The spring element 40 is attached to the respective external conductor A, B and biases the cutting element 38 to a position within housing 30 for which protrusions 42 formed on the periphery of cutting element 38 extend partially into the housing slot 34. When the interconnect stub 26 is inserted through aperture 36 and into housing slot 34, the spring element 40 yields and the cutting element 38 is displaced away from the slot 34 (upward as viewed in FIG. 2), allowing the stub 26 to be fully inserted into slot 34. When the interconnect stub 26 is partially extracted from the slot 34, the spring element 40 biases the protrusions 42 of cutting element 38 into engagement with the top insulation layer 18 of stub 26. Thereafter, the housing geometry restrains rotation of the cutting element 38, and the protrusions 42 dig into the insulation layer 18 and electrically contact the respective underlying planar conductor 13', 14' of the interconnect stub 26. This establishes an electrical connection between the respective planar conductor 13', 14' and external conductor A, B via the conductive cutting element 38 and the conductive spring element 40. Once the electrical connection has been established in this way, the locking mechanism 32 is slid rightward as viewed in FIG. 2 until the upper and lower ribs 52 of locking mechanism 32 are captured in the corresponding upper and lower troughs 54 of housing 30; this exerts a squeezing force on the end of housing 30, closing the slot 34 somewhat to firmly clamp the stub 32 in the housing 30. It will be realized, of course, that while only one cutting mechanism is depicted in FIG. 2, a connector 10 would have to contain one cutting mechanism for each planar conductor 13', 14' to be contacted, as shown more clearly in FIGS. 4 and 5.

In the preferred embodiment, the cutting element 38 is defined by a threaded cylinder 44 non-rotatably mounted on a splined axle 46, and is supported in a tapered recess 48 of housing 30. Two springs 40 (only one of which is shown in FIG. 2) engage the axle 46 on either side of cylinder 44, and urge the cylinder 44 leftward as viewed in FIG. 2 toward the apex 50 of tapered recess 48. In the left-most (illustrated) position, the protrusions 42 of cutting element 38 extend partially into the housing slot 34 as explained above. However, when the interconnect stub 26 is inserted into slot 34, it engages the protrusions 42 and pushes the cylinder 44 rightward within the recess 48, allowing the protrusions 42 to move upward and out of slot 34. Once the stub 26 has been fully inserted, partial extraction of the stub 26 causes the cylinder 44 to move leftward and downward once again. When the taper of the recess 48 prevents further leftward movement of the cylinder 44, it also grips the splined axle 46, preventing further rotation of the cylinder 44. Further extraction of the stub 26 causes the protrusions 42 to dig into insulation layer 18 to make electrical contact with the respective planar conductor 13', 14' as explained above.

Figure 3A:
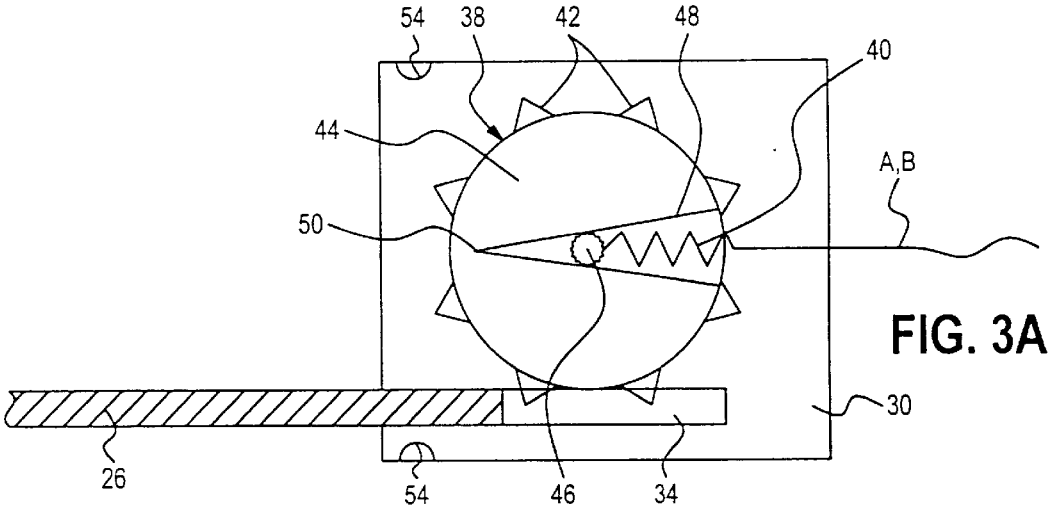
FIGS. 3A, 3B and 3C are schematic diagrams illustrating the attachment of the connector of FIG. 2 to the flexible circuit interconnect stub of FIG. 1.
Figure 3B:
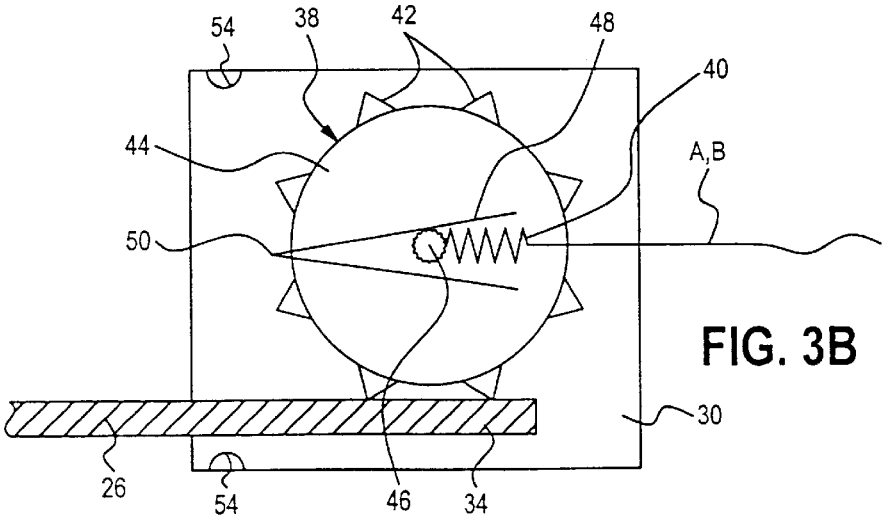
Figure 3C:
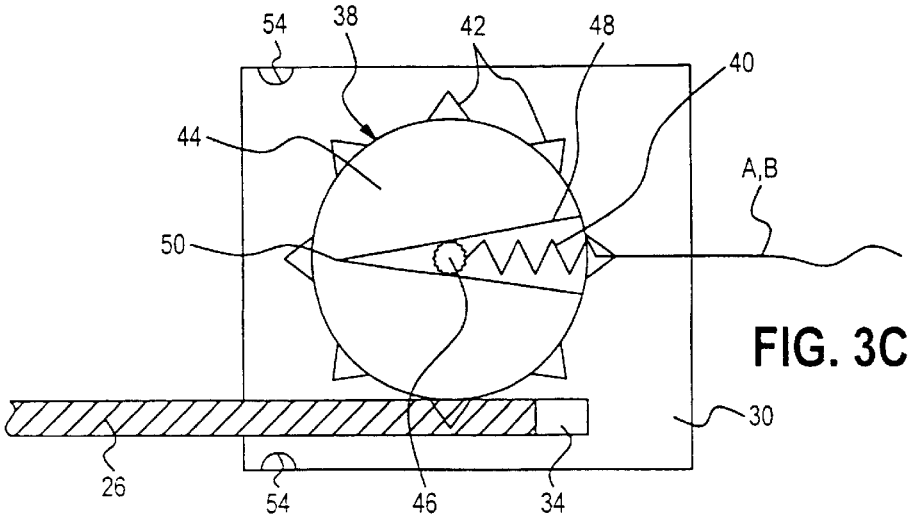

FIGS. 3A–3C illustrate various stages of the above-described sequence. In FIG. 3A, the circuit board 26 is partially inserted in slot 34, and the cutting mechanism 38 is positioned leftward in the recess 48. In FIG. 3B, the circuit board 26 is fully inserted into slot 34, and the cutting mechanism 38 is displaced rightward and upward due to the resulting interference between circuit board 26 and the cylinder protrusions 42. Specifically, the axle 46 is constrained by the upper tapered surface of recess 48 as shown. In FIG. 3C, the circuit board 26 is partially extracted from slot 34, allowing the spring 40 to bias cutting mechanism 38 leftward and downward as shown. When the axle 46 engages both upper and lower surfaces of the recess 48, interference between the outer periphery of axle 46 and recess 48 prevents the cutting mechanism 38 from rotating, and further incremental extraction of circuit board 26 causes the protrusions 42 to dig through the insulation layer 18 and make electrical contact with the respective planar conductor 13', 14'.

Figure 4:
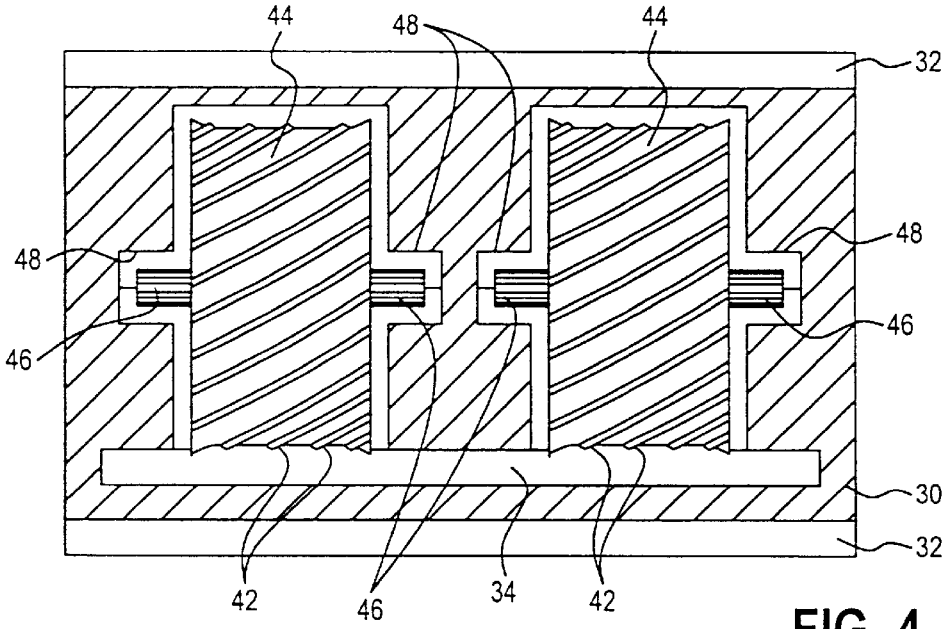
FIG. 4 is a partial cross-sectional end view of the connector of FIG. 2.
Figure 5:
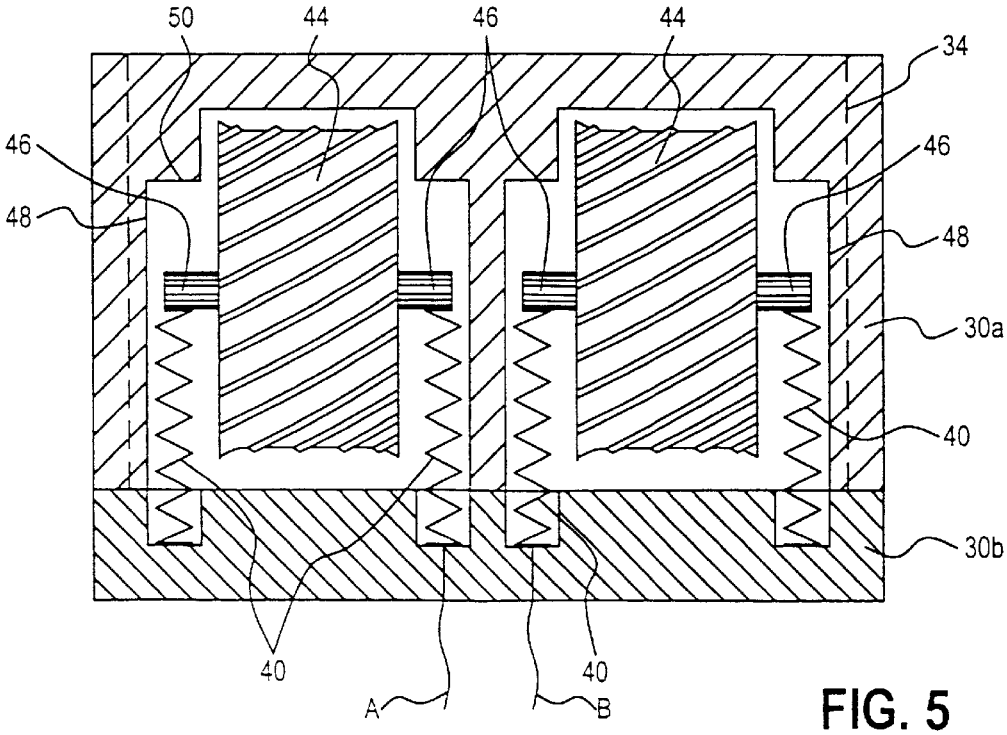
FIG. 5 is a partial cross-sectional top view of the connector of FIG. 2.

FIGS. 4 and 5 are end and top views (as denoted by arrows 4 and 5 in FIGS. 1 and 2, respectively) of the connector 10, illustrating two cutting mechanisms 38 disposed side-by-side for making electrical connections with the two planar conductors 13', 14' of FIG. 1. FIGS. 4 and 5 more clearly depict the splined periphery of axles 46 and the threaded periphery of cylinders 44. Additionally, it will be noted that each cylinder 44 has a non-uniform diameter to create a slight concavity. The concavity produces a non-uniformity in the insulation cutting depth, and is particularly useful in the illustrated embodiment of flexible circuit 12, as the conductors 13', 14' are covered by different insulation thicknesses; the conductor 13' is covered by insulation layer 18, whereas the conductor 14' is covered by both insulation layers 18 and 16. A similar effect may be achieved with a convex cylinder 44. In other applications, of course, the concavity (or convexity) may be unnecessary. Additionally, FIG. 5 shows that the housing 30 may be fabricated as two joined pieces: a front piece **30*a* defining the recess 48 and slot 34, and a rear piece 30*b* for holding the springs 40**.

In summary, the connector 10 of this invention utilizes an automatically deployed cutting mechanism 38 to establish an electrical connection between an external conductor A, B and an insulated flexible circuit board conductor 13', 14' without requiring prior removal of insulation layer(s) overlying the conductor. While described in reference to the illustrated embodiment, it is expected that various modifications in addition to those suggested above will occur to those skilled in the art. For instance, the housing piece **30*b* may be larger than shown, and may support (by insert molding, for example) leaf springs 40 that contact the axles 46. Additionally, various devices may be provided for ensuring alignment between the cutting mechanisms 38 and the conductors 13', 14'**. Also, alternative arrangements of housing pieces may be used to facilitate assembly of the internal components. Thus, it will be understood that the scope of this invention is not limited to the illustrated embodiment, and that connectors incorporating these and other modifications may fall within the scope of this invention, which is defined by the appended claims.

What is claimed is:

1. An electrical connector for establishing an electrical connection between an external conductor and a planar conductor of an insulated flexible circuit board, comprising:

an insulative housing having a slot for receiving a portion of said circuit board that includes an extension of said planar conductor;

an electrically conductive cutting mechanism supported for movement within said insulative housing within limits defined by a tapered recess of said housing in a manner to permit movement of said cutting mechanism between a deployed position in which the cutting mechanism at least partially extends into said slot in alignment with the extension of said planar conductor, and an un-deployed position in which said cutting mechanism is retracted from said slot; and an electrically conductive spring element electrically connected to said external conductor, and supported in said housing to contact said cutting mechanism and bias said cutting mechanism toward an apex of said tapered recess while yielding to permit said cutting mechanism to move away from said apex to said un-deployed position upon insertion of said circuit board portion into said slot, such that upon subsequent partial extraction of said circuit board portion, said spring element biases said cutting mechanism back toward the apex of said tapered recess, and said cutting mechanism penetrates an insulation layer of said circuit board and electrically contacts the extension of said planar conductor when said recess limits movement of said cutting mechanism in a direction of the spring element bias.

2. The electrical connector of claim 1, wherein said cutting element is defined by a cylinder non-rotatably mounted on an axle, and said spring element includes first and second springs contacting opposing ends of said axle to bias said cylinder toward said deployed position.

3. The electrical connector of claim 2, wherein a periphery of said cylinder is threaded to define protrusions that penetrate the insulation layer of said circuit board portion.

4. The electrical connector of claim 3, wherein said cylinder has a non-uniform diameter so that said protrusions penetrate the insulation layer of said circuit board to a non-uniform depth across a width of said circuit board portion.

5. The electrical connector of claim 2, wherein the opposing ends of said axle are supported in opposing tapered recesses of said housing, and such recesses define a limit position of axle movement that occurs when said cylinder is in said deployed position.

6. The electrical connector of claim 5, wherein said axles have a peripheral surface finish that prevents said cylinder from rotating when said axles are biased to said limit position.

* * * * *